US008251383B2

(12) United States Patent
Dickie

(10) Patent No.: US 8,251,383 B2
(45) Date of Patent: Aug. 28, 2012

(54) SKATEBOARD TRUCK ASSEMBLY

(76) Inventor: Paul C. Dickie, Clovis, CA (US)

( * ) Notice: Subject to any disclaimer, the term of this patent is extended or adjusted under 35 U.S.C. 154(b) by 315 days.

(21) Appl. No.: 12/383,318

(22) Filed: Mar. 23, 2009

(65) Prior Publication Data

US 2009/0256325 A1 Oct. 15, 2009

Related U.S. Application Data

(60) Provisional application No. 61/043,691, filed on Apr. 9, 2008.

(51) Int. Cl.
*B62M 1/00* (2010.01)

(52) U.S. Cl. ..... 280/87.042; 280/11.27; 280/11.28

(58) Field of Classification Search ..... 280/11.27, 280/11.28, 87.042
See application file for complete search history.

(56) References Cited

U.S. PATENT DOCUMENTS 4,311,319 A * 1/1982 Snyder et al. ..... 280/11.28
4,457,045 A * 7/1984 Kegg ..... 16/18 A
6,182,987 B1 * 2/2001 Bryant ..... 280/87.042
6,286,843 B1 * 9/2001 Lin ..... 280/11.28
7,093,842 B2 * 8/2006 Chmelar ..... 280/87.042

* cited by examiner

*Primary Examiner* — Hau Phan
*Assistant Examiner* — Bryan Evans
(74) *Attorney, Agent, or Firm* — Richard A. Ryan

(57) ABSTRACT

A skateboard truck assembly providing improved speed reduction or braking response when the rider places the skateboard in a rear tilt or tail drag position without sacrificing the skateboard's turning responsiveness. The truck assembly comprises a pair of axle distal sections, the portion of the axle extending beyond the ends of the hanger, that are angled relative to the riding surface. The angled axle sections causes the wheels to move in an outward direction, relative to the forward direction of the skateboard, when the skateboard is placed in a rear tilt position, resulting in drag that slows or stops the forward movement of the skateboard. Preferably, the truck assembly utilizes tapered wheels having an outer circumference which is larger than the inner circumference to provide improved speed reduction and turning stability. In addition, the pivot axis is more closely aligned or aligned with the axle axis to increase turning stability.

14 Claims, 7 Drawing Sheets

SKATEBOARD TRUCK ASSEMBLY

CROSS-REFERENCE TO RELATED APPLICATIONS

This patent application claims priority to U.S. Provisional Patent Application No. 61/043,691 filed Apr. 9, 2008.

STATEMENT REGARDING FEDERALLY SPONSORED RESEARCH

Not Applicable.

BACKGROUND OF THE INVENTION

A. Field of the Invention

The field of the present invention relates generally to skateboards and, more specifically, to truck assemblies utilized with skateboards. More particularly, the present invention relates to skateboard truck assemblies that provide a braking capability which allows the rider to reduce the speed of the skateboard so as to improve the safe operation thereof. Even more particularly, the present invention relates to such truck assemblies that automatically brake the skateboard when the rider places the skateboard in a rearward tilt or tail drag position without sacrificing the maneuverability and turning capabilities of the skateboard.

B. Background

Skateboards are one of the more popular forms of human powered sports and recreational devices that are utilized by a rider to move himself or herself across the ground or other surface. The standard skateboard has a generally narrow, elongated platform, commonly referred to as a deck, having a top surface on which the rider stands and a bottom surface against which a pair of wheel assemblies attach to allow the skateboard to roll across the ground in response to gravity and/or propelling action by the rider. The deck is sized to allow the rider to be able to place at least a portion of both of his or her feet on its upper surface when riding the skateboard. As well known by persons familiar with skateboards, the rider typically uses one of his or her feet to push against the ground in order to propel the skateboard and uses the tilting action of his or her body, usually with the feet generally transversely disposed on the deck, to change the skateboard's direction of travel. Although in the past the skateboard deck was usually configured to be substantially planar and primarily made out of wood, modern skateboard decks are known to have a variety of non-planar shapes, including having a generally uplifting front and/or back end, and are made out of a variety of different types of materials, including various metal, thermoplastic and composite materials.

The typical wheel assembly utilized with most modern skateboards comprises a baseplate that is fixedly secured to the bottom surface of the deck, a truck assembly and a pair of wheels rotatably supported by the truck assembly. The typical skateboard truck assembly, which is commonly referred to simply as a "truck", comprises a hanger that is secured to the baseplate by a kingpin, one or more compressible bushings which permit the hanger to pivot relative to the baseplate and the deck, and an axle which is supported by the hanger. One wheel is rotatably connected to each of the distal ends of the axle. For the standard skateboard, there is a wheel assembly located generally toward each of the front and back ends of the deck and the truck assemblies are fixedly attached to their respective baseplates with mechanical connectors, such as rivets, screws, bolts and/or specially configured adhesives. The pivoting motion allows the rider more control of the skateboard's movement. Typically, the wheels of a modern skateboard are made out of polyurethane or like materials and the various structural components of the truck assembly are made out of metal, such as aluminum or steel, or various composites.

The pair of wheels are typically mounted on a single axle that is substantially parallel to the riding surface. The truck assembly resiliently pivots about its connection with the board and thereby displaces the axle from its usual orientation perpendicular to the median longitudinal axis of the skateboard. The axles are displaced by tilting the board so that the axles each come to lie on a radius of a circle, thereby orienting the wheels so that they steer the skateboard generally along the circumference of the circle. The typical direction of travel for a skateboard is along the longitudinal axis of the deck. When a rider desires to turn the skateboard, he or she leans generally perpendicular to the direction of travel in the desired direction of the turn, thereby causing the hangers to pivot relative to the deck and turn the skateboard in that direction. Even when turning, the wheels on each truck of the skateboard have a similar direction of travel and follow the intended path of the skateboard. The arrangement of the wheels provides favorable cornering characteristics along with stability, enabling a skilled rider to negotiate smooth, sharp turns in rapid succession.

In learning how to ride a skateboard, and even later after a person becomes proficient in the use of a skateboard, it often becomes necessary to abruptly stop the skateboard to avoid danger, such as when an impediment is suddenly thrust into the skateboard rider's path of movement. Typically, the only way for a rider to stop his or her skateboard, at least commonly in use today, is for the rider to drag a foot along the riding surface, drag the tail of the skateboard deck on the riding surface or quickly dismount and let the board continue to move forward, resulting in the skateboard contacting the obstruction in the path of movement. None of these methods is particularly safe or effective. The problem with regard to stopping or slowing a skateboard is particularly evident when the skateboard is being ridden down a relatively steep and/or long hill. In such circumstances, the skateboard can often reach speeds that make the rider uncomfortable and which can be unsafe for the rider, particularly if he or she is a relatively novice rider. For many uses of standard skateboards, a mechanism for slowing down the skateboard without the rider having to get off the skateboard would be useful.

When a person rides a skateboard down a slope, he or she typically controls the speed of the skateboard by performing a generally zigzag movement that slows the speed of the skateboard, thereby allowing the rider to safely control the skateboard. Some skateboards have a brake device that is used to brake the skateboard when needed. In some prior art configurations, a conventional brake device is controlled by use of a brake cable that interconnects a hand-held brake lever and a brake mechanism that is located beside the wheels. A limitation of this type of braking device is that the rider cannot perform certain movements, which are somewhat commonly performed, if he or she has to grasp a brake lever in a his or her hand. One of the problems with any skateboard braking surface is the movement which the skateboard truck axle makes during the normal riding operation of the board. As stated above, the skateboard is intended to pivot from side to side with respect to the ground surface, since this is the manner in which the skateboard is turned. Any braking pad which is held by the skateboard itself, therefore, moves with respect to the wheel as the board is turned. As such, the braking pad of any braking system must be designed with a great deal of leeway and complexity to permit contact between the board and the axles when they are independently movable.

Over the years, various skateboard braking devices have been patented to improve the operation and safety of a skateboard. For instance, U.S. Pat. No. 3,288,251 to Sakwa discloses a skateboard brake system that uses a deck-mounted lever which connects to a pair of brake pads that rub against the outer surface of the wheels. U.S. Pat. No. 4,037,852 to Bayer, et al. discloses a skateboard braking apparatus having a brake with a lever that is located over the rear wheel assembly. When the lever is pressed down by the rider, the braking element contacts the wheels. One embodiment has two brake pads on each side that move outwardly to contact the inner face of the wheel. Another embodiment shows the use of pins that come into friction contact with the interior assembly of the rear wheels. U.S. Pat. No. 4,084,831 to Akonteh, et al. shows a skateboard brake having a braking pedal near the front wheel assembly of the skateboard. When the rider depresses the pedal, a bar rubs against the top of one of the front wheels. There are a number of disadvantages to a skateboard braking system that has a brake element which rubs against the outer surface of the skateboard wheels. First, the brake element can damage the wheel by its contact. Second, any dirt, water or grease on the wheel, which occurs often, can negatively impact the braking force exerted by the braking element when it rubs against the outer surface of the wheel.

Various prior art skateboard braking systems are incorporated into the wheel assembly below the lower surface of the deck. For instance, U.S. Pat. No. 6,793,224 to Stratton discloses a skateboard truck that includes an arm carried by the base and a spring-loaded linkage interconnecting the base and the arm to bias the arm towards a center position that is aligned with the skateboard's direction of movement. U.S. Pat. No. 6,315,304 to Kirkland et al. discloses an adjustable truck assembly for a skateboard that generally comprises an axle housing, a base, a kingpin connecting the axle housing and base, a turning mechanism between the axle housing and base around the kingpin consisting of opposed cam surfaces that are angled along the axis of the kingpin, an elastomeric bushing and an adjustment mechanism for adjusting the pressure against the bushing. These components are configured such that rotating the axle housing about the kingpin pushes the cam surfaces apart against the compression pressure of the elastomeric bushing. U.S. Pat. No. 6,523,837 to Kirkland discloses a similarly configured adjustable truck assembly, having a retainer that provides a large turning radius for the axle, a highly predictable turning performance and tool-less adjustment of the turning performance. U.S. Pat. No. 6,224,076 to Kent and U.S. Pat. No. D439,945 to Kent disclose a pneumatic compression strut skateboard truck assembly that utilizes a pneumatic compression strut suspension system, which is generally similar to that utilized in automobiles and other mechanical devices which employ shock absorbing technology. U.S. Pat. No. 5,971,411 to Jones, et al. discloses a skateboard truck that generally comprises an extruded skateboard truck base having an angled aperture for a cushion on which a hanger rests and a pivot bolt that holds the hanger to the base and allows weight placed on either side of the skateboard to put pressure on the cushion to facilitate a turn. U.S. Pat. No. 5,263,725 to Gesmer, et al. discloses a skateboard truck assembly having yoke, pivot pin and coil springs to provide rapid and consistent axle rebound to the straight-ahead position, consistent and predictable steering response, an improved balance between stability and maneuverability, fine steering control and a wide range of steering radii. U.S. Pat. No. 4,251,087 to Hansen discloses a truck apparatus for skate and skateboard devices that generally comprises an elongated kingpin, a means for affixing the upper end of the kingpin to the bottom of a load carrying platform, a wheel axle carriage assembly pivotally affixed to the lower end of the kingpin and adapted to rotate about the axis of the kingpin, a resilient drag sleeve and turn restoring element compressively disposed between the first and second friction surfaces, and a lock nut for selectively urging the carriage assembly toward the mid-portioned member so as to compress the drag sleeve between the first and second friction surfaces such that the carriage assembly may be resistively and partially resiliently rotated about the axis of the kingpin. U.S. Pat. No. 4,185,847 to Johnson and U.S. Pat. No. 4,176,850 to Johnson disclose skateboard trucks that have a plurality of wheels which are mounted in independent suspension, which generally comprise longitudinally extending arms that carry the wheel axles forwardly or rearwardly relative to a mounting that secures the arms in rotatable fashion to the trucks and which are resiliently biased by means of separate springs or torsion bars. U.S. Pat. No. 4,184,693 to Whitmarsh discloses a skateboard truck which generally comprises a base plate that secures to the underside of a skateboard deck and a spring member, such as a plate spring, that is joined to the base plate by one end and carries a wheel axle near an opposite end. U.S. Pat. No. 4,152,001 to Christianson discloses a truck assembly that comprises an S-shaped leaf spring that attaches to the skateboard and, through a pivot pin, carries a transverse axle-supporting member at the opposite end. A pair of upwardly and inwardly inclined compression springs are engaged by a pin carried by the leaf spring to resist pivotal movement of the leaf spring relative to the axle-supporting member.

While the foregoing patents and other prior art disclose apparatuses and devices that generally provide, or at least are intended to provide, improved braking for a skateboard so as to improve the safe operation thereof, they have certain limitations that have generally prevented full commercial acceptance of their respective inventions. What is needed, therefore, is an improved skateboard truck assembly for use with skateboards that allows the rider to reduce the speed of his or her skateboard without sacrificing control or maneuverability of the skateboard. The preferred skateboard truck assembly should allow a rider to quickly and effectively apply a braking action to slow or stop the movement of a skateboard. Preferably, the truck assembly should allow the rider to automatically brake the skateboard when he or she places the skateboard in a tail drag or rear tilted position. The preferred apparatus should be configured to be easily installed on and utilized with a wide variety of different types of skateboards and be able to enhance the aesthetic appeal of the skateboards.

SUMMARY OF THE INVENTION

The skateboard truck assembly of the present invention solves the problems and provides the benefits identified above. That is to say, the present invention discloses a skateboard truck assembly which allows the rider to reduce the speed of his or her skateboard without sacrificing control or maneuverability of the skateboard. The improved skateboard truck assembly of the present invention allows the rider to quickly and effectively apply a braking action to the skateboard by placing the skateboard in a tail drag or rear tilted position to slow or stop the forward movement of the skateboard. The present skateboard truck assembly can be easily installed on and utilized with a wide variety of different types of skateboards. The skateboard truck assembly of the present invention enhances the aesthetic appeal of the skateboard on which it is utilized, increases stability and provides a better grinding surface.

The skateboard truck assembly of the present invention pivots about two axes, the kingpin axis and the pivot pin axis, while providing a combination of lateral stability and turning capabilities that are usually only found on high end skateboards. A truck assembly configured according to a preferred embodiment of the present invention comprises a hanger having an axle shaft protruding from the opposing ends thereof and a wheel rotatably mounted at the distal end of each axle shaft. Each axle shaft extends from the end of the hanger at an angle other than parallel to the riding surface and hanger axis and is secured thereto on the side of the pivot pin axis distal from the point of securing the truck to the skateboard deck. Preferably, a skateboard truck assembly of the present invention is attached one to the front and one to the rear of a skateboard, as with conventional prior art skateboards. Because of the improved capabilities of the present invention the skateboarder is able rotate the skateboard and truck assembly into a tail drag position to induce speed reduction without actually dragging the tail of the board on the riding surface. When this maneuver is performed, the axle shaft angle is rotated out of its position resulting in a path of travel change for the wheels, which may be round, spherical or tapered, that induces drag on the system. This drag results in the application of a braking action on the skateboard. In addition to aiding in the reduction of speed this drag affect also allows the rider to perform a wide variety of typical skateboarding tricks with greater control and stability.

Accordingly, one of the primary aspects of the present invention is to provide a skateboard truck assembly for use on skateboards that has the advantages discussed above and overcomes the disadvantages and limitations associated with presently available skateboard truck assemblies.

It is an important aspect of the present invention to provide an improved skateboard truck assembly that allows the rider to easily and quickly reduce the speed of the skateboard without sacrificing control or maneuverability of the skateboard.

It is also an important aspect of the present invention to provide a skateboard truck assembly that allows the rider to apply a braking action to reduce the speed of the skateboard by placing the skateboard in a tail drag or rear tilt position without requiring the rear of the skateboard to contact the ground or other riding surface.

It is also an important aspect of the present invention to provide a skateboard truck assembly that comprises a pair of axle shafts protruding from opposite sides of an hanger at an angle other than parallel to the riding surface and hanger axis with a wheel rotatably mounted at the distal end of each axle shaft.

It is also an important aspect of the present invention to provide a skateboard truck assembly that allows the skateboard to be utilized in a typical riding manner as a skateboard having standard or conventional truck assemblies when not placed in its braking position to reduce the speed of the skateboard.

Another important aspect of the present invention is to provide a skateboard truck assembly that utilizes tapered wheels such that the orientation of the axles requires the inner circumference of the wheels to be smaller than the outer circumference of the wheels.

Yet another important aspect of the present invention is to provide a skateboard truck assembly that is easy to use, inexpensive to manufacture and adaptable to a variety of different skateboard configurations.

The above and other aspects and advantages of the present invention are explained in greater detail by reference to the attached figures and the description of the preferred embodiment which follows. As set forth herein, the present invention resides in the novel features of form, construction, mode of operation and combination of the above presently described and understood by the claims.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, the preferred embodiments of the present invention are set forth below. The enclosed figures and drawings are merely illustrative of one or more of the preferred embodiments and, as such, represent one or more ways of configuring the present invention. Although specific components, materials, configurations and uses are illustrated, it should be understood that a number of variations to the components and to the configuration of those components described herein and in the accompanying figures can be made without changing the scope and function of the invention set forth herein. For instance, although the figures and description provided herein show certain configurations for the skateboard truck assembly of the present invention, a skateboard utilizing such truck assembly and wheels mounted to the truck assembly, those who are skilled in the art will readily understand that this is merely for purposes of simplifying the present disclosure and that the present invention is not so limited.

Figure 3:
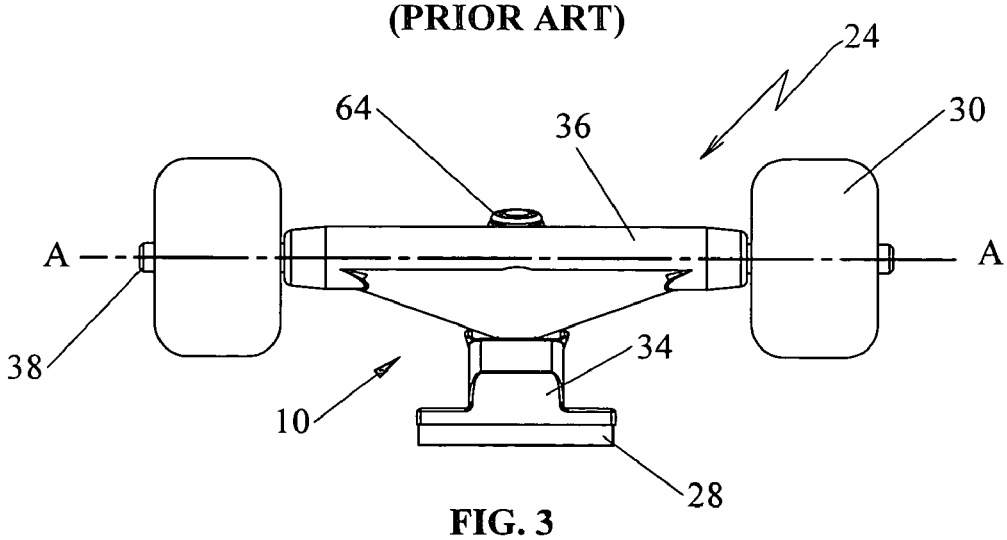
FIG. 3 (PRIOR ART)
FIG. 3 is a front view of a first wheel assembly showing the skateboard truck assembly of FIG. 1 with standard skateboard wheels attached to the axle thereof and mounted to a baseplate.

A skateboard truck assembly that is configured pursuant to the preferred embodiments of the present invention is identified generally as 100 in FIGS. 7 through 19. A prior art skateboard truck assembly 10 and a skateboard 12 utilizing the prior art skateboard truck assembly 10 are shown in FIGS. 1 through 6. FIG. 6 shows a typical prior art skateboard 12 in its assembled or rideable condition comprising a deck 14 having a forward or first end 16 and a rearward or second end 18, an upper surface 20 on which the rider stands as he or she rides the skateboard 12 and a lower surface 22. Mounted to the lower surface 22 of deck 14 is a first wheel assembly 24 disposed generally toward the first end 16 of deck 12 and second wheel assembly 26 disposed generally toward the second end 18 of deck 12. As best shown in FIG. 3 with regard to first wheel assembly 24, each of the first 24 and second 26 wheel assemblies comprise the truck assembly 10, a truck mount 28 that is disposed between truck assembly 10 and the lower surface 22 of deck 14, and a pair of standard skateboard wheels 30. As well known in the art with regard to a standard skateboard 12, typically the truck mount 28 is fixedly attached to the lower surface 22 of deck 14 and the truck assembly 10 is removably mounted to the truck mount 28 with the wheels 30 being outwardly disposed relative to the lower surface 22 of deck 14 such that when the rider stands on the upper surface 20 of deck 14 the wheels 30 contact the riding surface (shown as 32 in FIG. 16).

Figure 1:
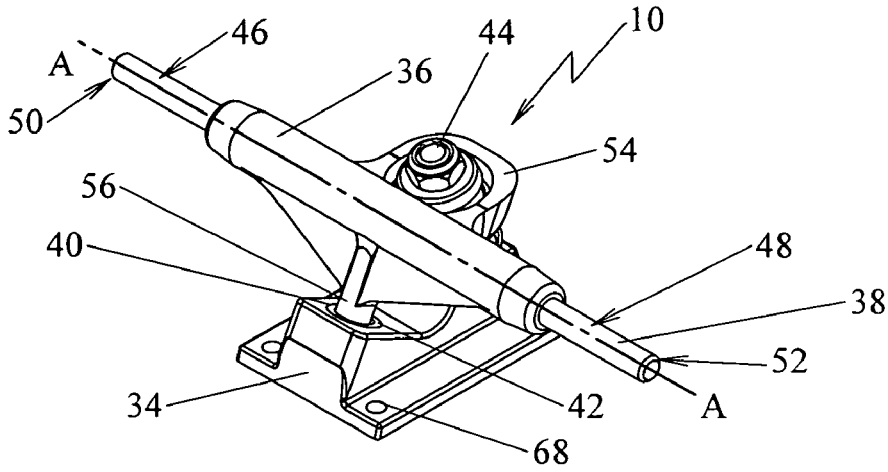
FIG. 1 (PRIOR ART)
FIG. 1 is a perspective view of a typical prior art skateboard truck assembly shown inverted for illustration purposes.
Figure 2:
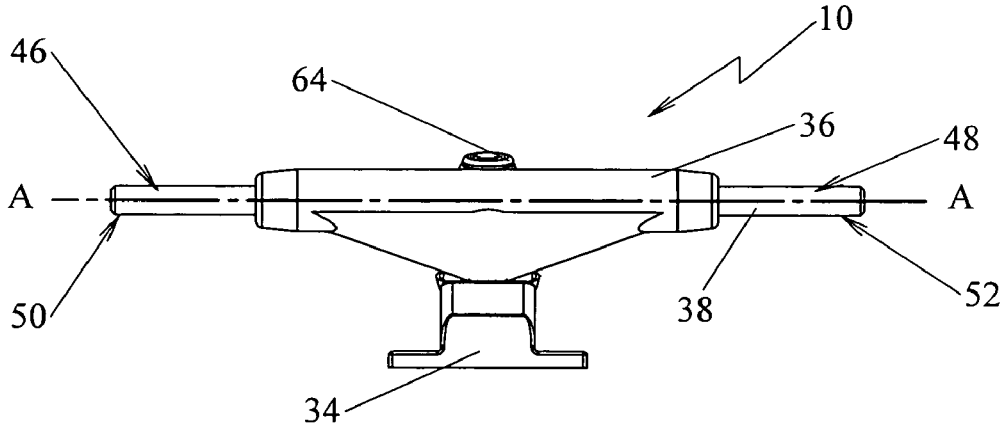
FIG. 2 (PRIOR ART)
FIG. 2 is a front view of the skateboard truck assembly of FIG. 1.
Figure 4:
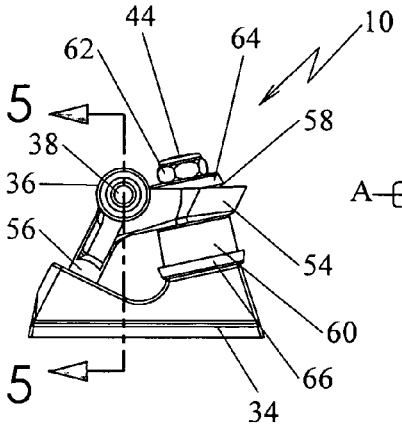
FIG. 4 (PRIOR ART)
FIG. 4 is a right side view of the skateboard truck assembly of FIG. 1.
Figure 5:
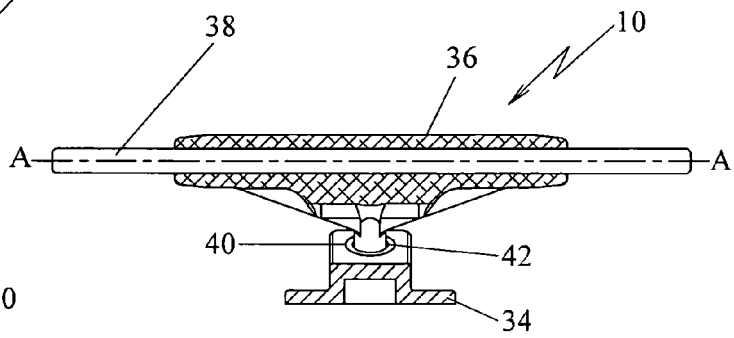
FIG. 5 (PRIOR ART)
FIG. 5 is a cross-sectional view of the skateboard truck assembly of FIG. 1 taken along line 5-5 of FIG. 4 particularly illustrating the single axle along the axis shown as A-A.
Figure 6:
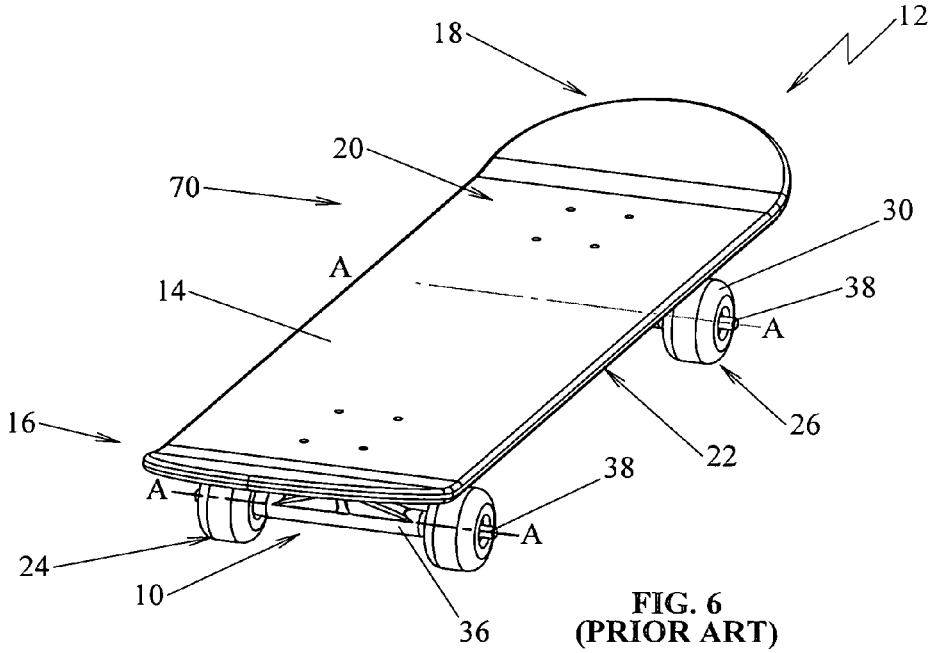
FIG. 6 (PRIOR ART)
FIG. 6 is a diametric view of a typical assembled prior art skateboard shown with the truck assembly and wheels of FIG. 3 mounted to the lower surface of a standard skateboard deck.
Figure 7:
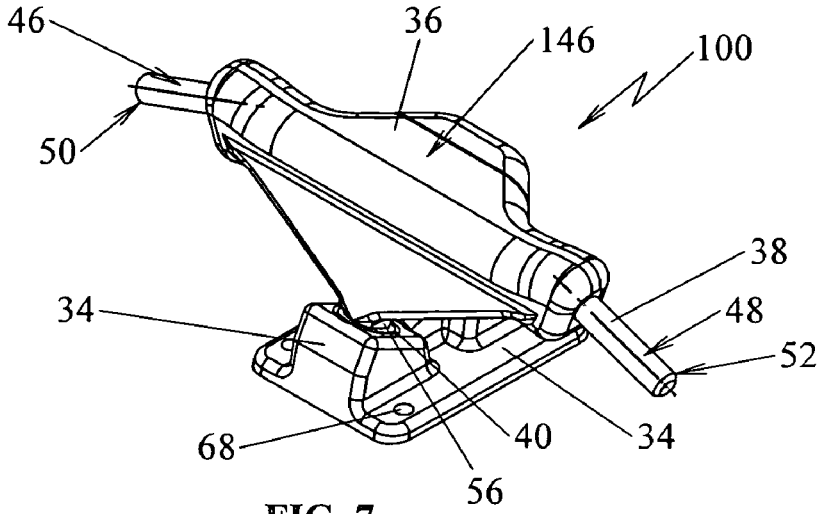
FIG. 7 is a perspective view of a skateboard truck assembly that is configured according to a preferred embodiment of the present invention shown inverted for illustration purposes.
Figure 8:
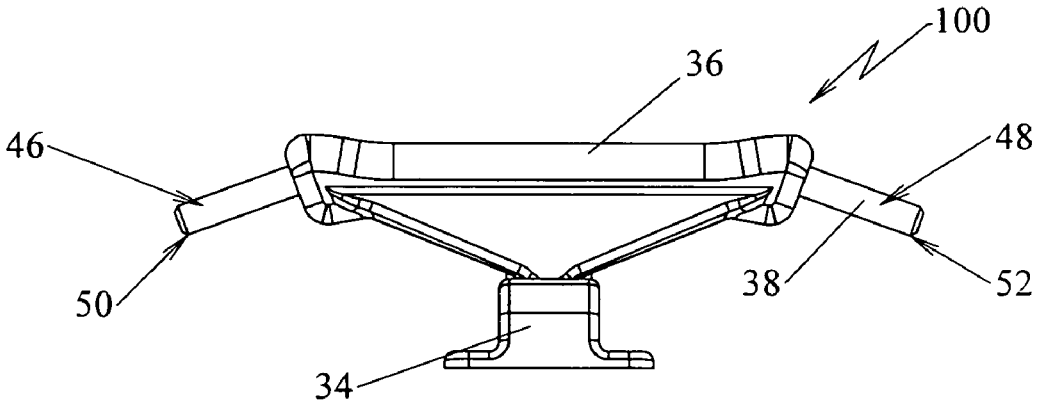
FIG. 8 is a front view of the skateboard truck assembly of FIG. 7.

Truck assembly 10, which is shown in FIGS. 1 through 5 in an inverted condition for purposes of illustration, generally comprises a baseplate 34, a hanger 36 and an axle 38. The baseplate 34 has a pivot recess 40 that accepts pivot cup 42 and a kingpin 44 that extends outwardly (up in FIGS. 1 through 4) from baseplate 34. Typically, hanger 36 supports a single elongated cylindrical axle 38 having a first distal section 46 and a second distal section 48 toward the first end 50 and second end 52, respectively, thereof that each rotatably receive a wheel 30 thereon. As shown in FIGS. 1 through 3 and 5, axle 38 has a typical axle axis of A-A with cylindrical shaft of axle 38 being concentric to the axis A-A. The hanger 36 of truck assembly 10 comprises a ring-shaped member 54 and a pivot stem 56. As best shown in FIG. 4, ring-shaped member 54 is sandwiched between an upper bushing 58 and a lower bushing 60 by use of a kingpin nut 62 that is attached to the upper end (as illustrated in the figures) of the kingpin 44, with an upper washer 64 disposed between the upper bushing 58 and kingpin nut 62 and a lower washer 66 disposed between the lower bushing 60 and baseplate 34. As known in the art, the wheels 30 are rotatably supported by axle 38 of the truck assembly 10 and secured thereto by one or more wheel connectors (not shown), such as a nut, pin or the like. FIG. 5, which is a cross-sectional view of the truck assembly 10 taken through lines 5-5 of FIG. 4, shows the shaft of axle 38 with a centerline axis of A-A. As shown in FIGS. 1 and 6, the prior art truck assembly 10 is attached to the lower surface 22 of deck 14, typically using bolt or screw through each of the mounting holes 68 in baseplate 34 that connect to truck mount 28.

The skateboard 12 of FIG. 6 is shown in a standard riding position 70, which has the main portion of deck 14 on which the rider stands substantially parallel to the riding surface 32, supported by wheels 30 on the riding surface 32, and the second end 18 (also referred to as the tail) disposed generally above the riding surface 32. One method of stopping or slowing the forward movement of the prior art skateboard 12 is for the rider to place the skateboard 12 in a "tail drag" or "rear tilt" position with the second end 18 of deck 14 sliding against the riding surface 32. The resulting friction between the second end 18 of deck 14 and the riding surface 32 slows the skateboard 12. A skilled rider can use this technique to relatively rapidly bring the skateboard 12 to a stop.

Figure 9:
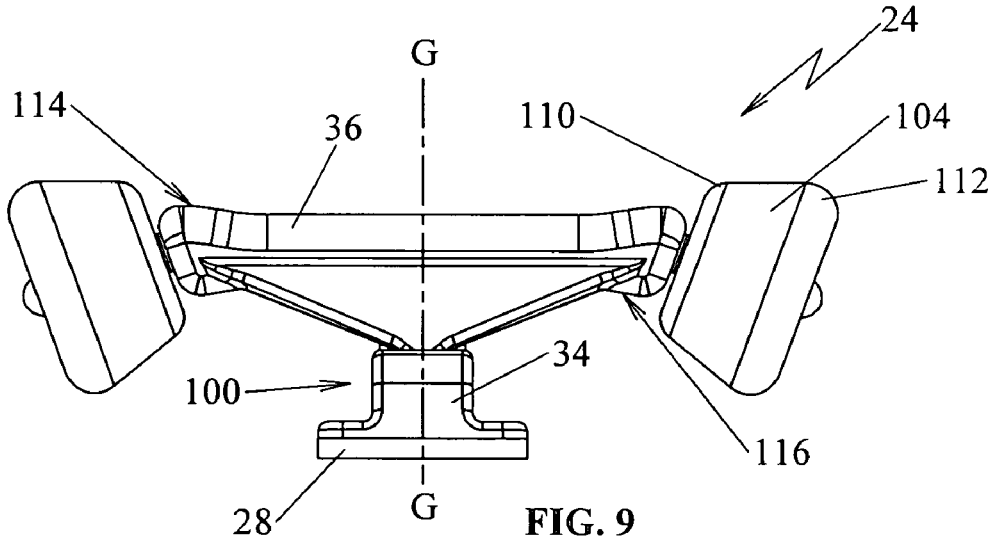
FIG. 9 is a front view of a first wheel assembly showing the skateboard truck assembly of FIG. 7 with tapered skateboard wheels attached to the axles thereof and mounted to a baseplate.
Figure 10:
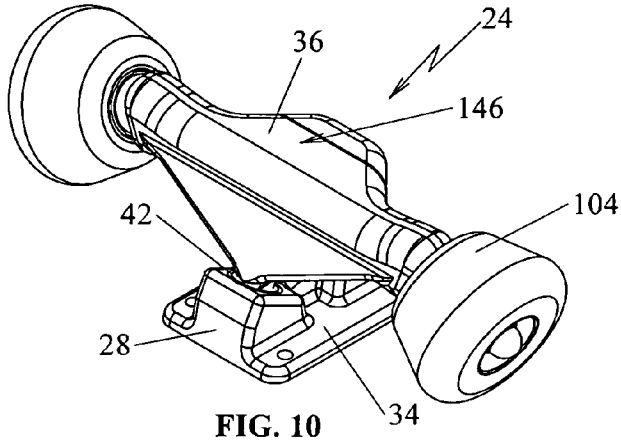
FIG. 10 is a perspective view of the first wheel assembly of FIG. 9.
Figure 12:
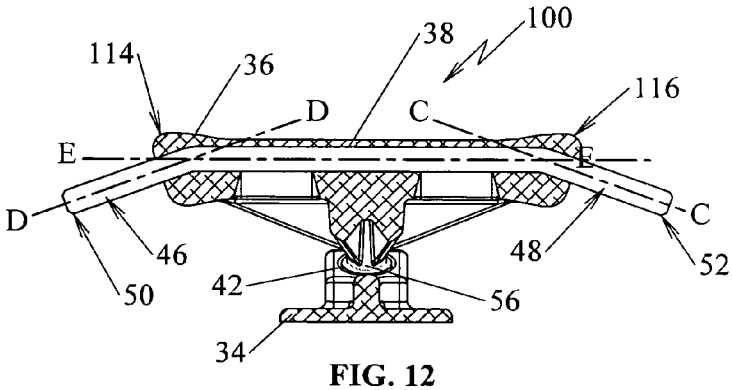
FIG. 12 is a cross-sectional view of the skateboard truck assembly of FIG. 7 taken along line 12-12 of FIG. 11 particularly illustrating the non-linear axis of the two axles as C-C and D-D.
Figure 13:
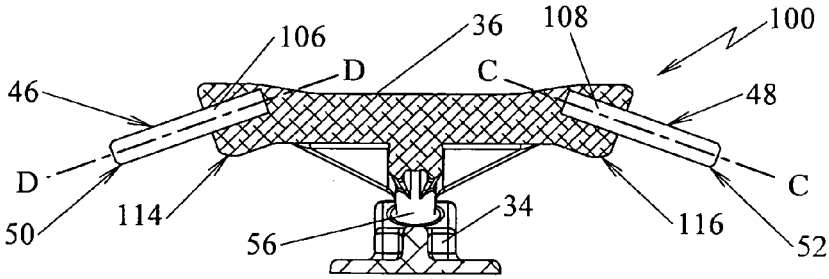
FIG. 13 is a cross-sectional view of an alternative embodiment of the skateboard truck assembly of the present invention showing the two axles having non-linear axis along lines C-C and D-D.
Figure 14:
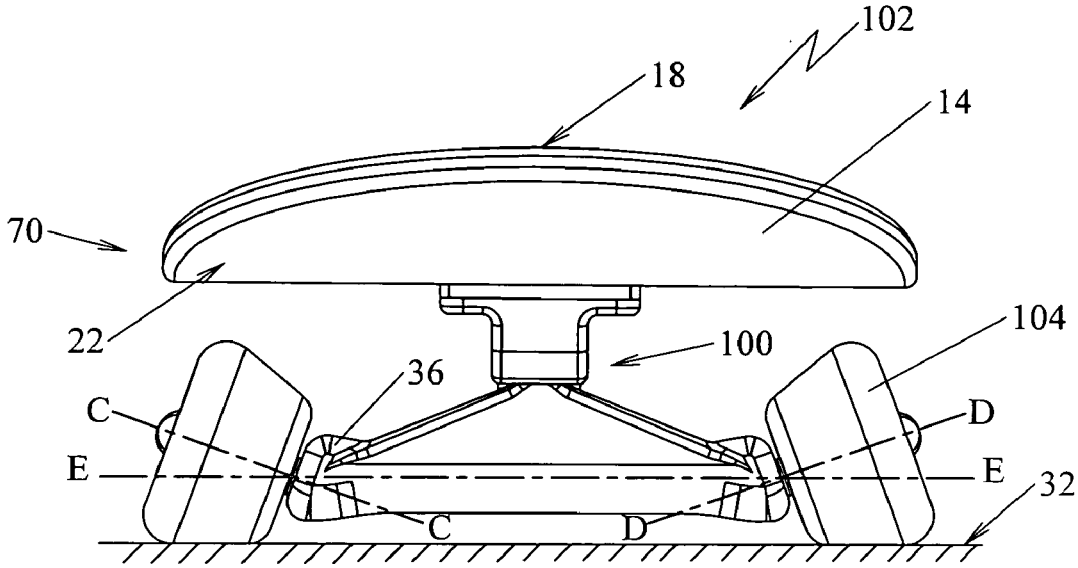
FIG. 14 is a front view of an assembled skateboard shown with the truck assembly and wheels of FIG. 9 shown mounted to the lower surface of a standard skateboard deck.
Figure 15:
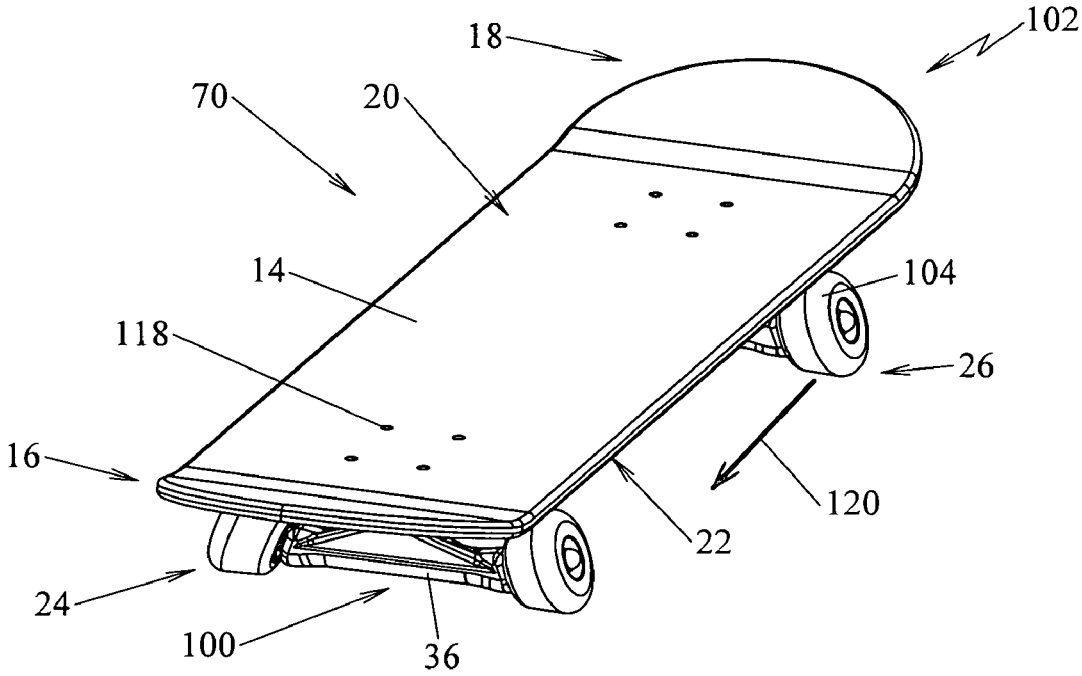
FIG. 15 is a diametric view of the assembled skateboard of FIG. 14.
Figure 16:
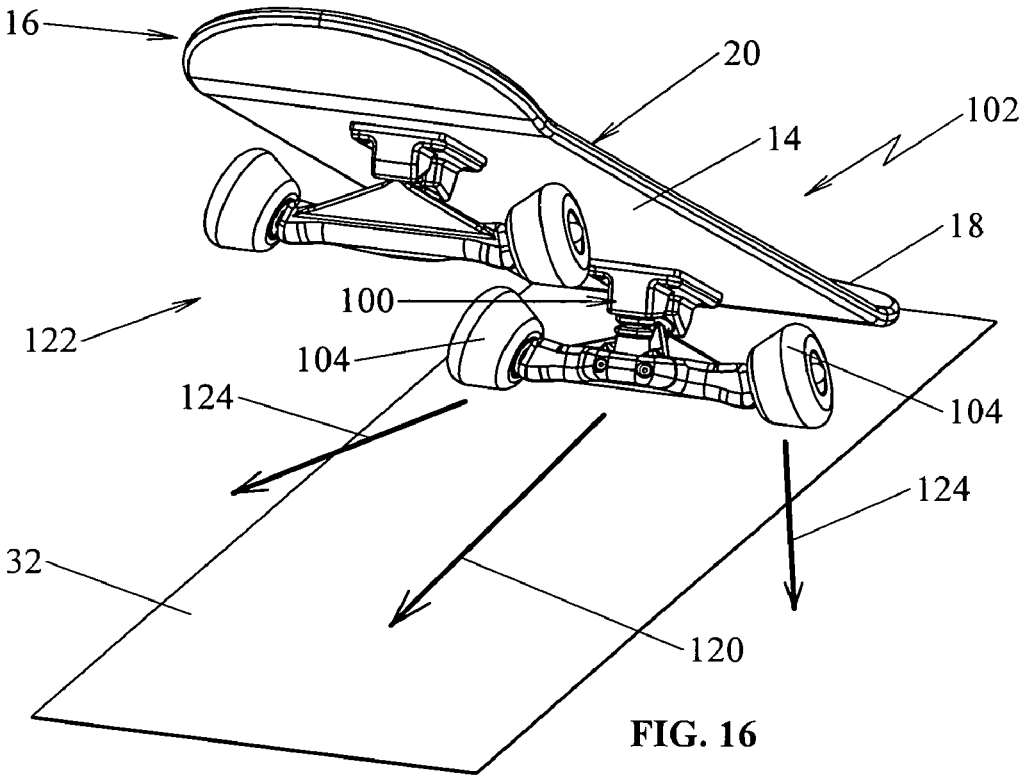
FIG. 16 is a diametric view of the skateboard of FIG. 15 shown in a trail drag or rear tilted position on a riding surface to illustrate the direction of travel of the wheels that apply a braking action to the skateboard.

As stated above, the improved skateboard truck assembly 100 of the present invention is shown in FIGS. 7 through 13, 17 and 18 and in use on an improved skateboard 102 in FIGS. 14 through 16. Many of the components of the prior art truck assembly 10 and skateboard 12 are utilized with the skateboard truck assembly 100 and skateboard 102 of the present invention. For purposes of clarity, the common components retain the same numerical designations as set forth above. As with skateboard 12, skateboard 102 has a first wheel assembly 24 disposed generally toward the first end 16 of deck 14 and a second wheel assembly 24 disposed generally toward the second end 18 of deck 14. A front view and a perspective view of first wheel assembly 24 for use with skateboard 102 are shown in FIGS. 9 and 10. Typically, the first 24 and second 26 wheel assemblies of skateboard 102 will be configured substantially the same, each having the improved skateboard truck assembly 100 that attaches, typically removably, to truck mount 28 on the lower surface 22 of deck 14. If desired, however, many of the advantages of the present invention can be obtained by only utilizing the skateboard truck assembly 100 with the rearward or second wheel assembly 26 to provide improved braking of skateboard 100, with the forward or first wheel assembly 24 having the prior art skateboard truck assembly 10. As shown in FIGS. 9 and 10 and described in more detail below, both truck assemblies 24 and 26 preferably utilize tapered wheels 104 in place of the prior art wheels 30. Alternatively, particularly if the prior art truck assembly 10 is utilized for first wheel assembly 24, the first wheel assembly 24 can utilize the standard wheels 30 while the second wheel assembly 26 utilizes the tapered wheels 104. In yet another alternative, both first 24 and second 26 wheel assemblies utilize the standard prior art wheels 30 (round or spherical, including roller blade type wheels) with truck assembly 100.

Figure 11:
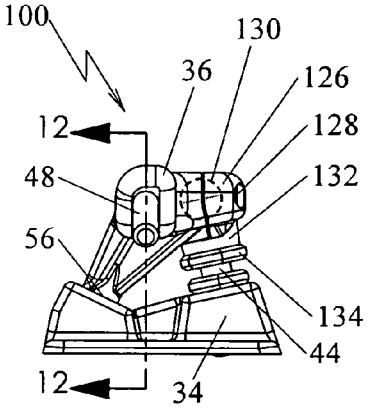
FIG. 11 is a right side view of the skateboard truck assembly of FIG. 7.
Figure 17:
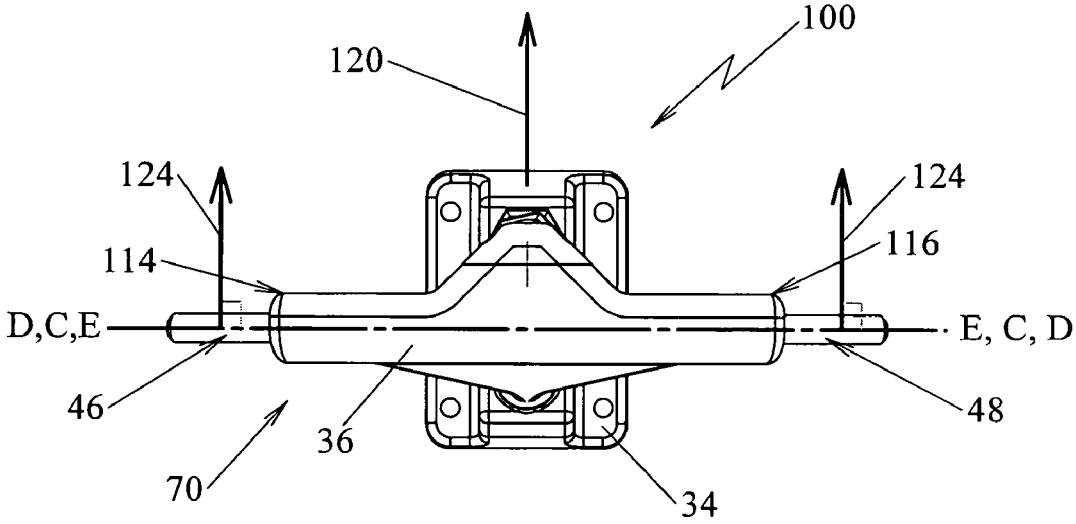
FIG. 17 is a bottom view of the skateboard truck assembly of FIG. 7 shown in a typical mounting position illustrating the axis E-E being in line with the axis C-C and axis D-D to provide a direction of travel for the wheels that is the same as the direction of travel of the skateboard for forward movement of the skateboard.

In one embodiment of the present invention, best shown in FIGS. 11 and 12, skateboard truck assembly 100 has a one-piece, formed axle 38 having first distal section 46 and second distal section 48 that extend beyond the first 114 and second 116 distal ends of hanger 36. In this embodiment, as set forth in more detail below, the upwardly angled distal sections 46 and 48 have a first axle axis C-C and a second axle axis D-D, respectively, that are at an upward angle relative to axle axis A-A of the main or central section of axle 38, which typically corresponds linearly or parallel to the hanger pivot axis E-E of hanger 36 (as best shown in FIG. 12), and relative to the riding surface 32 when skateboard 102 is in the standard riding position 70, as best shown in FIG. 14. Preferably, the upward angle is between 3 and 46 degrees, with a typical upward angle of approximately 20 degrees. As shown, first axle axis C-C and second axle axis D-D of first 46 and second 48 distal sections are upwardly disposed at an angle that is not linear to hanger pivot axis E-E when skateboard 102 is in riding position 70 and truck assembly 100 is viewed from the front or back. Preferably, first axle axis C-C and second axle axis D-D are linear to hanger pivot axis E-E when viewed from the bottom or top of truck assembly 100, as shown in FIG. 17. Axle 38 can be constructed of any metal or other material suitable for the purpose intended for truck assembly 100. In a preferred embodiment, the material for hanger 36 of truck assembly 100 is different than the material forming axle 38 to add structural support to the truck assembly 100. The first end 50 and second end 52 of axle 38 are shown with the centerline of each being on different planes and they are threaded for receiving and securing wheels 30 or wheels 104 on the respective first 46 and second 48 distal sections by means of a washer nut or the like familiar to those skilled in the art.

FIG. 13 shows an alternative embodiment of the present invention where the single piece axle 38 is replaced by a first axle member 106 and a second axle member 108 having distal sections 46 and 48, respectively, that extend beyond the distal ends 114 and 116 of hanger 36. In this embodiment, a wheel 30 or 104 is received onto first distal section 46 defined by first axle member 106 and on second distal section 48 defined by second axle member 108. As with the embodiment described above, each wheel 30 or 104 is secured onto axle members 104 and 106 by means of a washer nut or the like.

Figure 18:
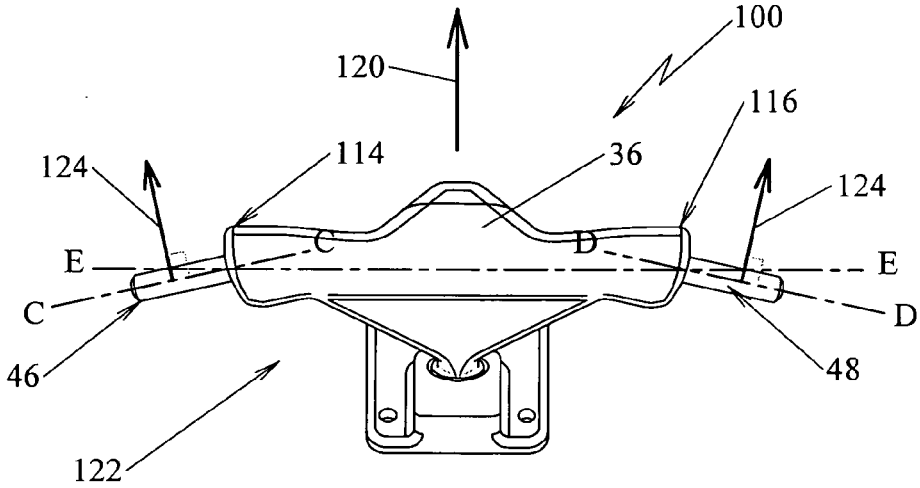
FIG. 18 is a bottom view of the skateboard truck assembly of FIG. 7 shown rotated into a tail drag or rear tilted position illustrating axis E-E, axis C-C and axis D-D as being non-linear to provide a direction of travel for the wheels that results in a braking action for the skateboard.

The improved skateboard truck assembly 100 of the present invention has baseplate 34, hanger 36 and axle 38 (FIG. 12) or first axle member 106 and second axle member 108 (FIG. 13) that have distal sections 46 and 48 extending outwardly and upwardly from the ends 114/116 of hanger 36. Unlike prior art truck assembly 10, however, the outwardly disposed distal sections 46/48 and ends 50/52 of axle 38 or axle members 106/108 are not concentric to each other and are not at an angle that is generally parallel to riding surface 32 when the skateboard 102 is in a standard (e.g., level, straight and forward) riding position 70, as best shown in FIGS. 12 through 15. As best shown in FIG. 18, first distal section 46 has a first axle axis shown as C-C and second distal section 48 has a second axle axis shown as D-D, which can be contrasted with the axle axis A-A shown with the prior art truck assembly 10. Typically, the prior art axle axis A-A is aligned with or at least parallel to the hanger pivot axis E-E, as shown in the embodiment of FIG. 12 with use of axle 38. As illustrated in these figures, the first axle axis C-C and the second axle axis D-D are not linear with the axle axis A-A and hanger pivot axis E-E. In addition, unlike wheels 30 tapered wheels 104 are not generally planar across the surface thereof. Instead, the tapered wheels 104 have an inner circumference 110 and an outer circumference 112, with the inner circumference 110 being closer than the outer circumference 112 to the median plane G-G of truck assembly 100 and the distal ends 114 and 116 of hanger 36 and the taper of tapered wheels 104 being configured such that the outer circumference 112 of the wheel 104 is larger than the inner circumference 110 of wheel 104, as best shown in FIGS. 9 and 14. An advantage of utilizing tapered wheels 104 with the skateboard truck assembly 100 of the present invention to is to reduce wheel bite, which is when the lower surface 22 of deck 14 hits the wheels 30 during a turn.

As with the prior art truck assembly 10, the skateboard truck assembly 100 of the present invention is statically secured to the lower surface 22 of deck 14 (typically with truck mount 28 therebetween) by utilizing one or more, usually a plurality, of deck connectors 118 (e.g. typically bolts or screws), as shown in FIG. 15, that are inserted through the mounting holes 68 in baseplate 34. FIG. 15 shows skateboard 100 in the standard riding position 70 with the main portion of deck 14 generally parallel to the riding surface 32 and the second end 18 of deck 14 in spaced apart relation to the riding surface 32, with the deck 14 being supported above the riding surface 32 by the tapered wheels 104 (or standard wheels 30 if utilized) that are rotatably mounted on the distal sections 46/48 of axle 38 or axle members 106/108. FIG. 15 also shows a forward direction of travel 120 that is utilized to indicate the preferred and usually intended path of travel of the skateboard 102 when in "normal" forward movement use. In contrast, FIG. 16 shows skateboard 102 rotated into a rear tilt (or tail drag if contact is made with riding surface 32) position 122 as it continues to move in the forward direction 120 for the purpose of performing a trick with skateboard 102 or slowing skateboard 102. As stated above, in the rear tilt position 122, second end 18 of deck 14 is tilted downward until it is close to or in contact with riding surface 32, which results in the first end 16 of deck 14 being tilted upward. As result of the rearward tilting of skateboard 102, the truck assembly 100 of second wheel assembly 26 is rotated back at the same angle as the deck 14. This maneuver still allows forward direction of travel 120, but results in new direction of travel for wheels 30 or wheels 104, shown as wheel travel 124 in FIG. 16. As shown in FIG. 16, wheel travel 124 angles in a generally outward direction relative to the forward direction of travel 120 such that the wheel travel 124 of wheels 30/104 are diverging away from each other and the path of the forward direction of travel 120. This diverging, outwardly angled direction for wheels 30 or 104 imparts a drag on the system that slows or stops the skateboard 102.

FIG. 17 is a bottom view of skateboard truck assembly 100 when mounted to the lower surface 22 of deck 14 and skateboard 102 is traveling in a typical forward direction of travel 120, resulting in the hanger axis E-E being linear to first axle axis C-C and second axle axis D-D. The forward direction of travel 120 is perpendicular to first axle axis C-C and second axle axis D-D, resulting in unimpeded straight forward travel of the skateboard 102. In contrast, FIG. 18 is a bottom view of the truck assembly 100 when mounted to the lower surface 22 of deck 14 and the skateboard 102 is in a rear tilt position 122. As shown, this maneuver results in the hanger pivot axis E-E and the first axle axis C-C and the second axle axis D-D, of first distal section 46 and second distal section 48, respectively, being non-linear (as viewed from the bottom view and a top view). In this position, both first axle axis C-C and second axle axis D-D are at outward, opposing angles to the hanger pivot axis E-E. The wheel direction of travel 124 for the wheel 104 on first axle member 106 is perpendicular to the first axle axis C-C and the wheel direction of travel 124 for the wheel 104 on second axle member 108 is perpendicular to the second axle axis D-D, resulting in a drag on the skateboard 102 as the wheel direction of travel 124 of these wheels 104 opposes the forward direction of travel 120 of skateboard 102. This drag creates the speed reducing or braking effect of the present invention and provides for improved stability when the rider is attempting to perform typical skateboarding tricks.

As set forth above, when the rider places the skateboard 102 in the rear tilt position 122, as shown in FIG. 16, the skateboard 102 slows its speed in the forward direction of travel 120 as the wheels 30 or 104 travel outward in the wheel direction of travel 124 due to the drag induced by the angled first 46 and second 48 distal sections of axle 38 or axle members 106 and 108. While the truck assembly 100 can utilize the standard wheels 30, it is preferred that the tapered wheels 104 be utilized. The use of the standard wheels 30 with the angled first 46 and second 48 distal sections will tend to brake as the rider makes a turn with the skateboard 102, which often would not be a desired feature for riders of skateboard 102. In addition, the use of tapered wheels 104 provides a more pronounced or quicker braking effect than the use of standard wheels 30, which can be very important when the rider needs to quickly slow skateboard 102 to avoid hitting an object or losing control of skateboard 102.

Figure 19:
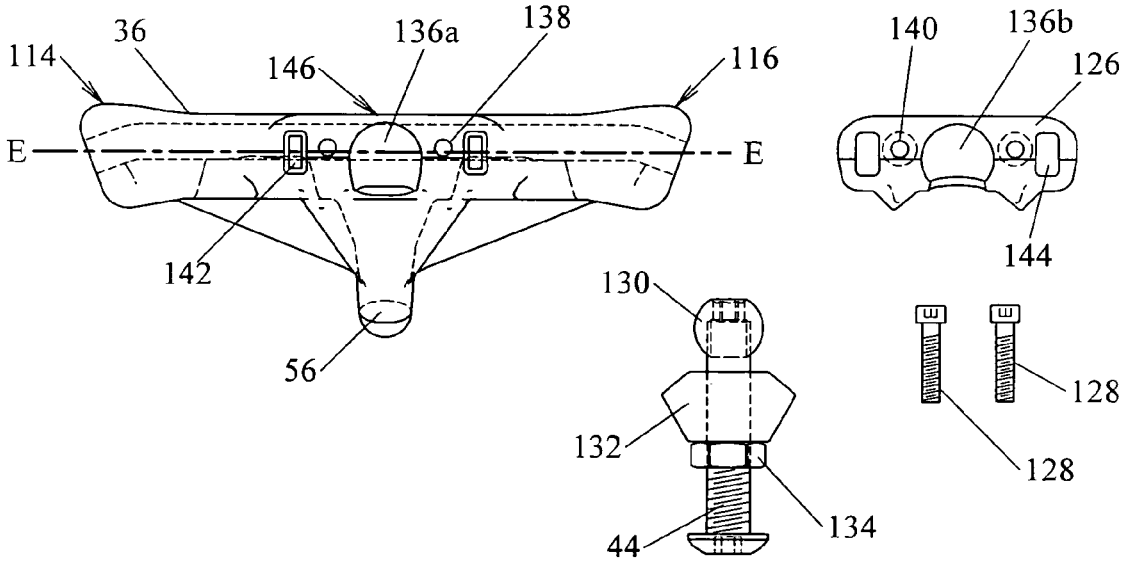
FIG. 19 is a exploded back view of an alternative embodiment of a hanger having a kingpin cap configured to encapsulate a pivot ball shown at the end of the kingpin with a bushing and jam nut thereon.

In one embodiment of the skateboard truck assembly 100 of the present invention, the basic configuration of truck assembly 10, except for the angled distal sections 46/48 and ends 50/52 of axle 38 or axle members 106/108 which provide the benefits described above, can be utilized with truck assembly 100. Preferably, however various other improvements are made to skateboard truck assembly 100. For instance, preferably the hanger 36 of skateboard truck assembly 100 includes a kingpin receiver cap 126 that is attached to the hanger 36 by one or more fastening means 128, such as a bolt, screw or the like, as best shown in FIG. 11. The kingpin receiver cap 126 encapsulates a pivot ball 130 positioned at the end of kingpin 44 nearest the hanger 36, which is the upper end of kingpin 44 when the truck assembly 100 is viewed in the inverted position of FIG. 11 or the lower end of kingpin 44 when truck assembly 100 is mounted on skateboard 102 and the skateboard 102 is in its standard riding position 70. A bushing 132 is mounted over the kingpin 44 and forced against the surface of hanger 36 by a jam nut 134 or the like. As best shown in FIG. 19, the hanger 36 and kingpin cap 126 each have one-half of a pivot chamber 136 (formed from the halves 136*a* and 136*b*) in which the pivot ball 130 at the end of kingpin 44 is received. The hanger 36 and kingpin cap 126 can have apertures 138 and 140 for receiving the fastening means 128 to join the kingpin cap 126 to the hanger 36. If desired, a guiding means such as the slot 142 in hanger 36 and projection 144 on kingpin cap 126 can be utilized to assist the rider with properly joining the kingpin cap 126 to the hanger 36. The rider tightens the jam nut 134 to achieve his or her desired turning responsiveness for skateboard 102. As with the prior art truck assembly 10, the pivot stem 56 on which the hanger 36 pivots rests in the pivot cup 42. Preferably, the bushing 132 is made out of an elastomer material that is chosen for its desired skateboarding properties. The higher the durometer of the material, the more resistant to turning. This provides a "tighter" truck assembly 100 that is less responsive and, as a result, better stays with the rider. A softer durometer material will more quickly pop back to its neutral position after the rear tilting to provide a more responsive truck assembly 100 that is better suited for street use to allow the rider to more quickly avoid colliding with objects.

The truck assembly 100 of the present invention provides improved stability due to the use of pivot ball 130 that results in the hanger pivot axis E-E being at the axle axis A-A. In contrast, the prior art truck assembly 10 has the pivot being approximately at the one-half position of the kingpin 44, resulting in the axle 38 being angled relative to the ground surface 32 during a turn. The improved truck assembly 100 pivots about the pivot ball 130, which keeps the angle parallel to the riding surface 32 during a turn and prevents the drag being introduced when turning. Another advantage of the truck assembly 100 of the present invention is that the use of the kingpin cap 126 provides a smooth bottom surface 146 for hanger 36, shown in FIGS. 7, 10 and 19, for the truck assembly 100 that avoids problems with the skateboard 102 getting hung up on the kingpin nut 64 when performing certain skateboarding tricks, such as grinding on a rail or other surface. In addition to not getting hung up, the smooth bottom surface avoids damage to the kingpin nut 64 that can make it difficult for the rider to remove the truck assembly 10 and provides a more pronounced grinding feel that is preferred by many riders.

In use, the skateboard truck assembly 100 of the present invention is utilized in place of the prior art standard truck assembly 10 by statically mounting the truck assembly 100 to the truck mount 28 that is fixedly attached to the lower surface 22 of deck 14 using deck connectors 118 through the mounting holes 68 of the baseplate 34 of truck assembly 100. Preferably, the truck assembly 100 is provided with the tapered wheels 104 at each of the first 46 and second 48 distal sections of axle 38 or axle members 106/108. In one embodiment, the improved truck assembly 100 is utilized with both of the first 24 and second 26 wheel assemblies. In an alternative embodiment, the truck assembly 100 is utilized with only the rearward or second wheel assembly 26 to provide the desired braking effect to slow or stop skateboard 102. When riding skateboard 102, the rider merely places the skateboard 102 in a rear tilt position 122 to slow or stop the forward movement of the skateboard 102 by inducing drag as the wheels 104 move in a wheel direction of travel 124 that is outward relative to the forward direction of travel 120 of skateboard 102. This drag provides the desired slowing or braking for skateboard 102.

While there are shown and described herein specific forms of the invention, it will be readily apparent to those skilled in the art that the invention is not so limited, but is susceptible to various modifications and rearrangements in design and materials without departing from the spirit and scope of the invention. In particular, it should be noted that the present invention is subject to various modification with regard to any dimensional relationships set forth herein and modifications in assembly, materials, size, shape and use. For instance, there are numerous components described herein that can be replaced with equivalent functioning components to accomplish the objectives of the present invention.

What is claimed is:

1. A skateboard truck assembly, comprising:

a baseplate for securing said truck assembly to a deck of a skateboard;

a hanger having a first distal end and a second distal end, said hanger having a hanger pivot axis therethrough;

a kingpin interconnecting said hanger and said baseplate so as to secure said hanger to said baseplate;

a kingpin cap removably attached directly to said hanger and independent of said kingpin;

a pivot ball on said kingpin;

a pivot chamber disposed in said hanger in alignment with said kingpin, said pivot chamber defined by said hanger and said kingpin cap, said pivot chamber sized and configured to at least substantially encapsulate said pivot ball;

one or more compressible bushings disposed on said kingpin against said hanger; and one or more axles supported by said hanger, said one or more axles defining a first distal section extending beyond said first distal end of said hanger and a second distal section extending beyond said second distal end of said hanger, said first distal section upwardly angled so as to provide a first distal axis in nonlinear alignment with said hanger pivot axis and said second distal section upwardly angled so as to provide a second distal axis in nonlinear alignment with said hanger pivot axis, each of said first distal section and said second distal section configured to rotatably mount a wheel thereto;

wherein each of the wheels mounted on said first distal section and said second distal section will move in a wheel direction of travel angled outwardly relative to a forward direction of travel for the skateboard when the skateboard is rotated from a standard riding position to a rear tilt position so as to slow forward movement of the skateboard.

2. The truck assembly according to claim 1, wherein each wheel is a tapered wheel having an outer circumference that is larger than an inner circumference thereof.

3. The truck assembly according to claim 1, wherein said pivot chamber is located in said hanger so as to position said pivot ball substantially on said hanger pivot axis when said pivot ball is received in said pivot chamber.

4. The truck assembly according to claim 1 further comprising a means on said kingpin for selectively compressing said bushing against said hanger.

5. The truck assembly according to claim 1, wherein said hanger and said kingpin cap define a generally smooth bottom surface on said hanger.

6. The truck assembly according to claim 1, wherein said one or more axles comprises a first axle member defining said first distal section and a second axle member defining said second distal section.

7. A skateboard truck assembly, comprising:

a baseplate for securing said truck assembly to a deck of a skateboard;

a hanger having a first distal end and a second distal end, said hanger having a hanger pivot axis therethrough;

a kingpin interconnecting said hanger and said baseplate so as to secure said baseplate to said hanger;

one or more compressible bushings disposed on said kingpin against said hanger;

a kingpin cap removably attached directly to said hanger and independent of said kingpin;

a pivot ball on said kingpin;

a pivot chamber disposed in said hanger in alignment with said kingpin, said pivot chamber defined by said hanger and said kingpin cap, said pivot chamber sized and configured to at least substantially encapsulate said pivot ball; and one or more axles supported by said hanger, said one or more axles defining a first distal section extending beyond said first distal end of said hanger and a second distal section extending beyond said second distal end of said hanger, said first distal section upwardly angled so as to provide a first distal axis in nonlinear alignment with said hanger pivot axis and said second distal section upwardly angled so as to provide a second distal axis in nonlinear alignment with said hanger pivot axis, each of said first distal section and said second distal section configured to rotatably mount a wheel thereto, wherein each of the wheels mounted on said first distal section and said second distal section will move in a wheel direction of travel angled outwardly relative to a forward direction of travel for the skateboard when the skateboard is rotated from a standard riding position to a rear tilt position so as to slow forward movement of the skateboard.

8. The truck assembly according to claim 7, wherein each wheel is tapered so as to have an outer circumference that is larger than an inner circumference thereof.

9. The truck assembly according to claim 7 further comprising a means on said kingpin for selectively compressing said bushing against said hanger.

10. The truck assembly according to claim 7, wherein said hanger and said kingpin cap define a generally smooth bottom surface on said hanger.

11. The truck assembly according to claim 7, wherein said one or more axles comprises a first axle member defining said first distal section and a second axle member defining said second distal section.

12. A skateboard, comprising:

a deck having a first end, a second end, an upper surface and a lower surface;

a first wheel assembly disposed generally toward said first end of said deck, said first wheel assembly comprising a truck assembly mounted to said deck and a pair of wheels rotatably mounted to said truck assembly, said truck assembly having a baseplate, a hanger supporting one or more axles, a kingpin securing said hanger to said baseplate, a kingpin cap removably attached directly to said hanger independent of said kingpin, a pivot ball on said kingpin and a pivot chamber disposed in said hanger in alignment with said kingpin, said pivot chamber defined by said hanger and said kingpin cap, said pivot chamber sized and configured to at least substantially encapsulate said pivot ball, said hanger having a hanger pivot axis therethrough, said one or more axles defining an outwardly extending first distal section having one of said pair of wheels rotatably mounted thereon and an outwardly extending second distal section having the other of said pair of wheels rotatably mounted thereon; and a second wheel assembly disposed generally toward said second end of said deck; said second wheel assembly comprising a truck assembly mounted to said deck and a pair of wheels rotatably mounted to said truck assembly, said truck assembly having a baseplate, a hanger supporting one or more axles, a kingpin securing said hanger to said baseplate, a kingpin cap removably attached directly to said hanger independent of said kingpin, a pivot ball on said kingpin and a pivot chamber disposed in said hanger in alignment with said kingpin, said pivot chamber defined by said hanger and said kingpin cap, said pivot chamber sized and configured to at least substantially encapsulate said pivot ball, said hanger having a hanger pivot axis therethrough, said one or more axles defining an outwardly extending first distal section having one of said pair of wheels rotatably mounted thereon and an outwardly extending second distal section having one of said pair of wheels rotatably mounted thereon, each of said first distal section and said second distal section upwardly angled so as to provide a first distal axis and a second distal axis that are in nonlinear alignment with said hanger pivot axis;

wherein each of said wheels mounted on said first distal section and said second distal section of said truck assembly of said second wheel assembly will move in a wheel direction of travel angled outwardly relative to a forward direction of travel for said skateboard when said skateboard is rotated from a standard riding position to a rear tilt position so as to slow forward movement of said skateboard.

13. The skateboard according to claim 12, wherein said pivot chamber of each of said first wheel assembly and said second wheel assembly is located in said hanger so as to position said pivot ball substantially on said hanger pivot axis when said pivot ball is received in said pivot chamber.

14. The skateboard according to claim 13, wherein said hanger and said kingpin cap define a generally smooth bottom surface on said hanger.

* * * * *